US012421756B2

(12) United States Patent
Schneider et al.

(10) Patent No.: US 12,421,756 B2
(45) Date of Patent: Sep. 23, 2025

(54) DECORATIVE TOPPER SYSTEM AND METHOD

(71) Applicant: Barrette Outdoor Living, Inc., Middleburg Heights, OH (US)

(72) Inventors: Christopher Michael Schneider, Linwood, NJ (US); Christopher Rolland Clark, Morristown, TN (US); Paige Barbara Moore, Absecon, NJ (US); Patrick Joseph Bertke, Mays Landing, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 294 days.

(21) Appl. No.: 17/974,858

(22) Filed: Oct. 27, 2022

(65) Prior Publication Data

US 2024/0141684 A1 May 2, 2024

(51) Int. Cl.
*E04H 17/16* (2006.01)

(52) U.S. Cl.
CPC ..... *E04H 17/16* (2013.01)

(58) Field of Classification Search
USPC ..... 256/11
See application file for complete search history.

(56) References Cited

U.S. PATENT DOCUMENTS 4,159,820 A * 7/1979 Parisien ..... E04H 17/24 403/399
5,882,001 A * 3/1999 Reinbold ..... E04H 17/1447 256/65.09
8,763,303 B2 * 7/2014 Johnson ..... E04H 17/22 47/32.4
9,234,368 B2 * 1/2016 Zhu ..... F16B 7/0446
9,500,001 B2 * 11/2016 Sherstad ..... E04H 17/16
10,335,707 B2 * 7/2019 Nunes ..... A63K 1/00
11,549,279 B2 * 1/2023 Hodgson ..... E04H 17/16
2005/0285091 A1 * 12/2005 Ko ..... E04H 17/1488 256/24
2007/0252125 A1 * 11/2007 Thompson ..... E04H 17/163 256/24
2008/0006808 A1 * 1/2008 Thompson ..... E04H 17/163 256/45
2009/0166599 A1 * 7/2009 Lo ..... E04H 17/1417 256/65.01
2011/0073823 A1 * 3/2011 Mitrovic ..... E04H 17/1439 256/65.01
2020/0069047 A1 * 3/2020 Brennan ..... A47B 13/003

OTHER PUBLICATIONS

Canadian Office action mailed Jul. 3, 2025 in connection with the corresponding Canadian Patent Application No. 3,211,546 (6 pages total).

* cited by examiner

*Primary Examiner* — Matthew R McMahon
(74) *Attorney, Agent, or Firm* — John Maldjian, Esq.; Stevens & Lee PC

(57) ABSTRACT

A system includes a top rail configured at an initial position. The system also includes one or more plugs positioned underneath the top rail. The one or more plugs and top rail are positioned within a same connected device. The one or more plugs include spring clips to enable the top rail and one or more plugs to be connected to a top portion of a fence. The system also includes a mid-rail positioned at the top portion of the fence, wherein the mid-rail is configured to receive the one or more plugs.

19 Claims, 6 Drawing Sheets

DECORATIVE TOPPER SYSTEM AND METHOD

FIELD OF INVENTION

Embodiments of the present invention generally relate to decorative topper system configured within the top portion of a fence-gate system.

BACKGROUND

Fence structures will often not have the aesthetic enhancement that is often desired. Further, fence structures may often also not have the structural enhancement to provide support for the various members of the fence. The various members can include the gate posts and the vertical pickets that pass vertically through each portion of the fence.

The gate posts and vertical pickets may not have the aesthetic appeal that the owners of the fence structure would desire. Further, the top portion of the fence can often have a unaesthetic appeal. The unaesthetic appeal can be that a portion of the gate posts extend over the fence on both ends, without a structure to meet the top end of the gate posts. The vertical picket members will also only have a top mid-rail covering and bottom rail cover. No structure will be positioned above the vertical pickets, which can lead to an unaesthetic viewing of the fence structure.

The structural enhancement of the mid-rail covering over the vertical pickets can be lacking. There can be no structural support for the mid-rail other than with the vertical pickets. The top portion of the gate posts will also lack the structural enhancement as there will be an open area between the top portions of the gate posts at both ends.

Accordingly, a fence structure is needed that will provide structural enhancement. The additional enhancement should provide additional structural support for the mid-rail of the fence, the gate posts, and the entire fence structure. In addition, the fence structure also needs an aesthetic enhancement throughout the fence structure. An additional structure can provide additional aesthetic appeal without the open space between both ends of the top portions of the gate posts. An aesthetic enhancement is also needed for the mid-rail and the vertical pickets within the fence structure as well. Overall, an additional structure is needed to provide structural and aesthetic enhancement for the fence structure.

SUMMARY

Embodiments in accordance with the present invention provide system. The system includes a top rail configured at an initial position. The system also includes one or more plugs positioned underneath the top rail. The one or more plugs and top rail are positioned within a same connected device. The one or more plugs include spring clips to enable the top rail and one or more plugs to be connected to a top portion of a fence. The mid-rail is positioned at the top portion of the fence. The mid-rail is configured to receive the one or more plugs.

The system includes one or more external clips to secure the one or more plugs and top rail onto the mid-rail.

The system also includes a decorative panel positioned between the top rail and the one or more plugs.

In an embodiment of the present invention, a system includes a first rail configured at a first position. The system also includes a decorative panel positioned underneath the first rail, wherein the decorative panel is configured to be connected to the first rail. The system also includes a plurality of plugs configured underneath the decorative panel and first rail. The plurality of plugs are connected to the decorative panel and first rail. The plurality of plugs enable the first rail and decorative panel to be connected to a second rail. The second rail is positioned underneath the plurality of plugs. The second rail is configured with a plurality of holes. The plurality of holes enable the plurality of plugs to connect the first rail and decorative screen panel to the second rail. The second rail is positioned over one or more vertical pickets.

The system also includes the one or more spring clips positioned around the plurality of plugs to enable the plurality of plugs to be connected to the second rail.

The system also includes one or more external clips to secure the press plugs and decorative panel onto the second rail.

According to another embodiment of the present invention, a method includes configuring a top rail at an initial position. The method also includes positioning one or more plugs underneath the top rail. The one or more plugs and top rail are positioned within a same connected device. The one or more plugs include spring clips to enable the top rail and one or more plugs to be connected to a top portion of a fence. The method also includes configuring a mid-rail at the top portion of the fence. The mid-rail is configured to receive the one or more plugs.

The method also includes configuring external connectors or clips around the top rail and the mid-rail to secure the connection between the top rail and mid-rail.

The method also includes positioning a decorative panel between the one or more plugs and top rail.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

Figure 1:
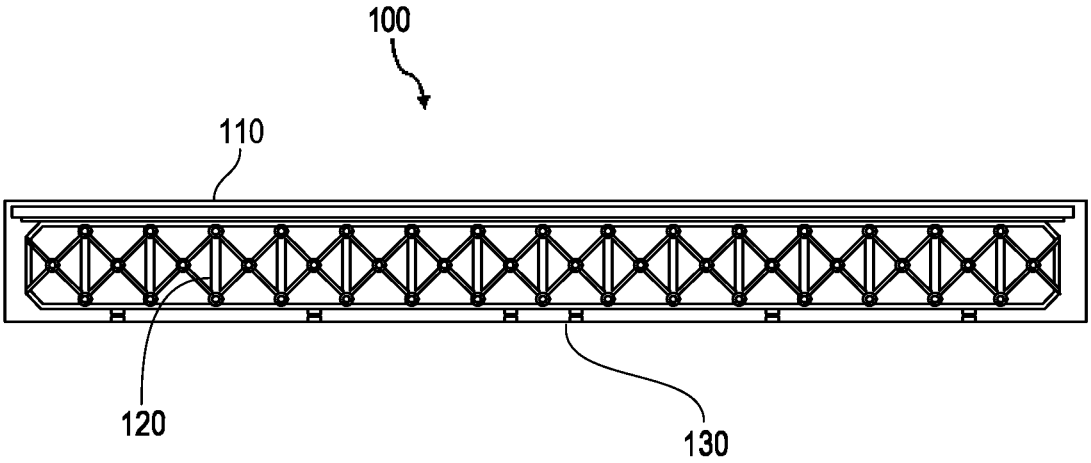
FIG. 1 illustrates a view of the decorative topper system.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures. Optional portions of the figures may be illustrated using dashed or dotted lines, unless the context of usage indicates otherwise.

DETAILED DESCRIPTION

A decorative topper system can include a top rail that is initial separate from a decorative panel. The decorative panel can include locking shim parts on the top portion of the decorative panel. The top rail can use the locking shim parts to connect to the decorative panel. The top rail and decorative panel can be interconnected as part of the same structure, or decorative topper system. The decorative topper system can be used to provide a decoration on a top portion of a fence. The decorative topper system can also provide structural enhancement and support for the fence structure.

The bottom portion of the decorative panel will include press plugs. Spring clips will be positioned around each of the press plugs. The press plugs and spring clips can be used to connect the entire decorative topper system to the fence structure. The press plugs can connect openings in a top portion of the fence.

The top portion of the fence includes a mid-rail. The mid-rail will include picket openings. The picket openings will enable the fence to receive the decorative topper system. The picket openings will enable the press plugs to be positioned within the mid-rail. The spring clips will also assist the press plugs in being positioned in the picket openings within the mid-rail. As a result the decorative topper system will be placed within and on the mid-rail or top portion of the fence.

An external foam connector can secure the top rail onto the decorative panel. The external foam connector can be positioned around both the top rail and the decorative panel to ensure that the top rail and decorative panel remain interconnected. An external clip will be positioned around the decorative panel and mid-rail. As a result, the decorative panel will remain secured on the mid-rail.

The decorative topper system can provide structural enhancement of the fence structure. The gate posts will provide structural support for the decorative topper system. The mid-rail will also provide structural support for the decorative topper system. The entire decorative topper system will receive structural support from the gate posts and mid-rail of the fence structure. In addition, the decorative topper system will provide aesthetic enhancement for the fence structure. The fence structure will have an increased aesthetic appeal due to the aesthetic enhancement at the top of the fence structure by the decorative topper system.

In FIG. 1, a decorative topper system 100 is illustrated. The decorative topper system can be configured with components that can eventually all be placed at a top portion of a fence. The decorative topper system 100 can be positioned above vertical pickets of a fence. Further, the various separate components of the decorative topper system 100 can be merged together before being placed atop the top portion of the fence. The top portion of the fence will include a mid-rail with a plurality of holes. The plurality of holes will enable the decorative topper system 100 to be connected to the top portion of the fence. In addition, the decorative topper system can be configured between gate posts and in contact with the top portion of the fence.

Referring to FIG. 1, the decorative topper system 100 includes a top rail 110. The top rail can be a separate component. The decorative topper system will include the decorative panel 120. The top portion of the decorative panel 120 will include one or more locking shim parts. The top rail 110 can be placed in contact with the shim parts on the top portion of the decorative panel to connect the top rail 110 to connect to the decorative panel 120. The bottom portion of the decorative panel will include press plugs 130. The press plugs 130 will each include one or more spring clips. The one or more spring clips around the press plugs 130 will enable the press plugs 130 to connect to the picket holes that are configured within the mid-rail on the top portion of the fence.

In FIG. 1, when all of the components of the decorative topper system 100 have been connected, the decorative topper system 100 can be positioned within the mid-rail on the top portion of the fence. The press plugs 130 can be placed within the picket holes within the mid-rail. The spring clips positioned around the press plugs 130 will enable the press plugs 130 to be secured within the mid-rail. As such, the decorative topper system 100 can be secured between two gate posts and on the top portion of the fence within the fencing system. The decorative topper system 100 will provide structural enhancement for the fence structure, and enhance the aesthetic appeal of the fence structure as well.

Figure 2:
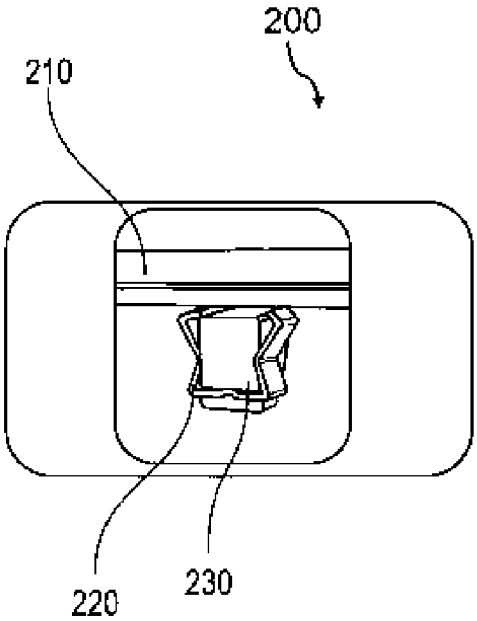
FIG. 2 illustrates another aspect of the decorative topper system.

In FIG. 2, a portion of the decorative topper system 200 is shown. More specifically, the decorative panel 210, or the bottom portion of the decorative panel 210 is shown. Underneath the decorative panel 210 is press plug 230. A spring clip 220 is configured around the press plug 230. The press plug 230 and spring clip 220 is used to attach the decorative panel 210 and top rail to the mid-rail located at the top portion of the fence. The mid-rail will include a series of picket holes. Each press plug 230 and corresponding spring clip 220 will be placed into the corresponding picket hole within the mid-rail. Each spring clip 220 enables each press plug 230 to be secured within the corresponding picket hole of the mid-rail. When each press plug 230 is secured within the corresponding picket hole, the decorative panel 210 and also the top rail of the decorative topper system are secured at the top portion of the fence. The decorative panel 210 and top rail are configured over the mid-rail and within two gate posts as the press plugs 230 and spring clips 220 are within the picket holes within the mid-rail and above the vertical pickets. Accordingly, each spring clip 220 and press plug 230 enables the decorative topper system to be secured onto the top portion of the fence.

Figure 3:
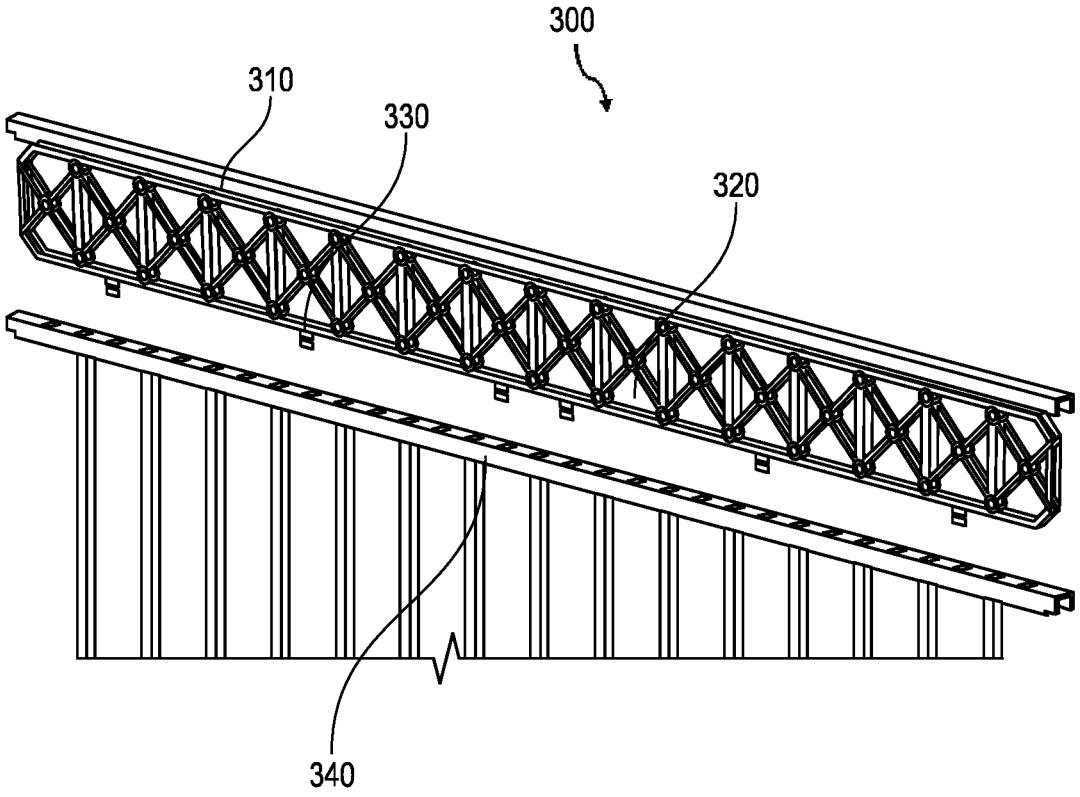
FIG. 3 illustrates view of the decorative topper system.

Referring to FIG. 3, the decorative topper system 300 is shown in more detail in relation to a top portion of a fence. The decorative topper system 300 will include a series of components that are put together into an interconnected structure. When the components of the decorative topper system 300 are each connected within the same structure, the decorative topper system 300 can then be placed at a top portion of a fence.

In FIG. 3, the top rail 310 is shown. The top rail 310 can originally be separate from the decorative panel 320. Nevertheless, locking shim parts at the top of the decorative panel will enable the top rail 310 to be connected to the decorative panel 320. When the top rail 310 is connected to the decorative panel 320, the decorative topper system 300 can then be connected to the mid-rail 340 of the fence structure. The press plugs 330 are positioned underneath the decorative panel 320 and also underneath the top rail 310. Each of the press plugs 330 will include a spring clip configured around the press plug 330. The spring clips will enable the press plug 330 to be configured within the picketing holes of the mid-rail 340.

Referring to FIG. 3, the mid-rail 340 will be positioned above a series of vertical pickets that are part of the fence structure. The picket holes will be positioned within the mid-rail 340 above the vertical pickets. The press plugs 330 and corresponding spring clips will be positioned within a corresponding picket hole within the mid-rail 340. Moreover, when press plugs 330 are secured within the picket holes, the decorative topper system 300 can be secured onto the top portion of the fence structure. The structural advantages of the picket holes enable the fence structure to add the decorative topper system 300 that includes the top rail 310, decorative panel 320, and press plugs 330 with attached spring clips. The spring clips configured around the press plugs 330 can ensure that the press plugs 330 and thereby the entire decorative topper system 300 is positioned securely within the mid-rail 340. As a result of the picket holes, the fence structure is able to securely add the decorative topper system 300 securely as part of the same interconnected structure. The decorative topper system 300 will also provide structural enhancement and an aesthetic enhancement for the mid-rail 340 and other components of the fence structure.

Figure 4:
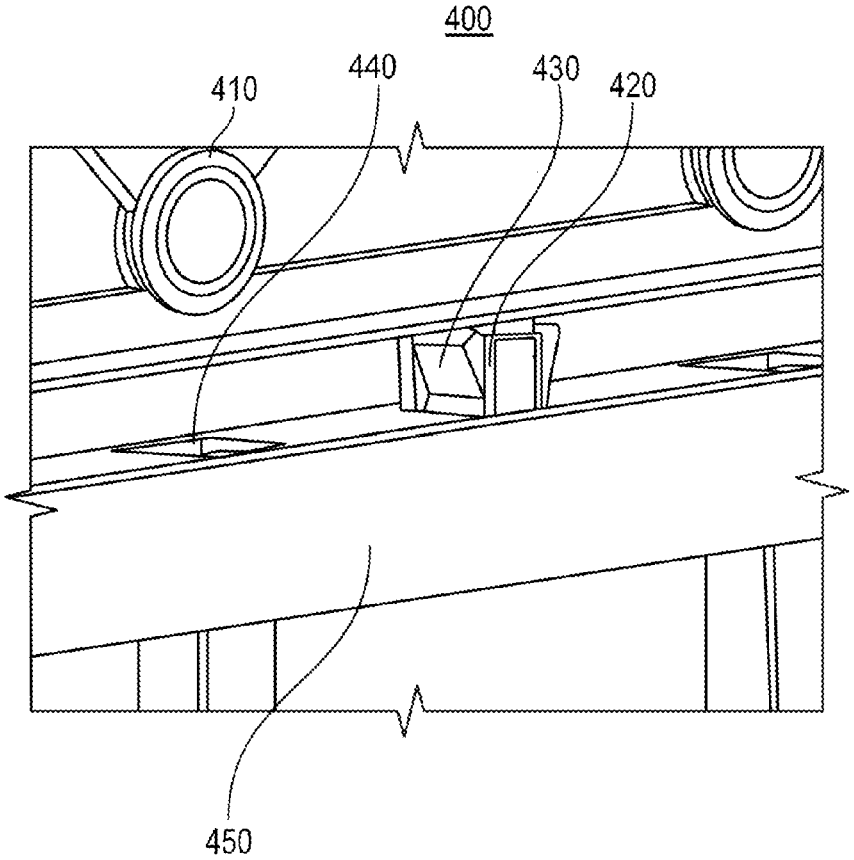
FIG. 4 illustrates another aspect of the decorative topper system.

In FIG. 4, another view of the decorative topper system 400 in relation to the top portion of the fence structure is shown. The decorative panel 410 is illustrated. Underneath the decorative panel 410 is one of the press plugs 420 with the corresponding spring clip 430. The picket holes 440 are shown within the mid-rail 450 of the fence structure.

Referring to FIG. 4, the decorative system 400 appears as an interconnected structure with the decorative panel 410, the press plug 420, and spring clip 430. The top rail will be positioned over the decorative panel 410. As such, the press plug 420 and spring clip 430 are positioned within the corresponding picket hole 440. The picket holes 440 in various positions within the mid-rail 450 enable the fence structure to be able to add the decorative topper system 400 within the same interconnected structure. The spring clip 430 enables the press plug 420 to be configured securely within the picket hole 440. The press plug 420 will be secured within the picket hole 440 that is positioned above the vertical pickets within the fence structure. As a result, due to each spring clip 430 and picketing hole 440, the decorative topper system 400 can be interconnected with the mid-rail 450 within the same fence structure. Moreover, the gate posts at opposite ends of the fence structure will also be part of the same interconnected structure as the mid-rail 450 and decorative topper system 400.

Figure 5:
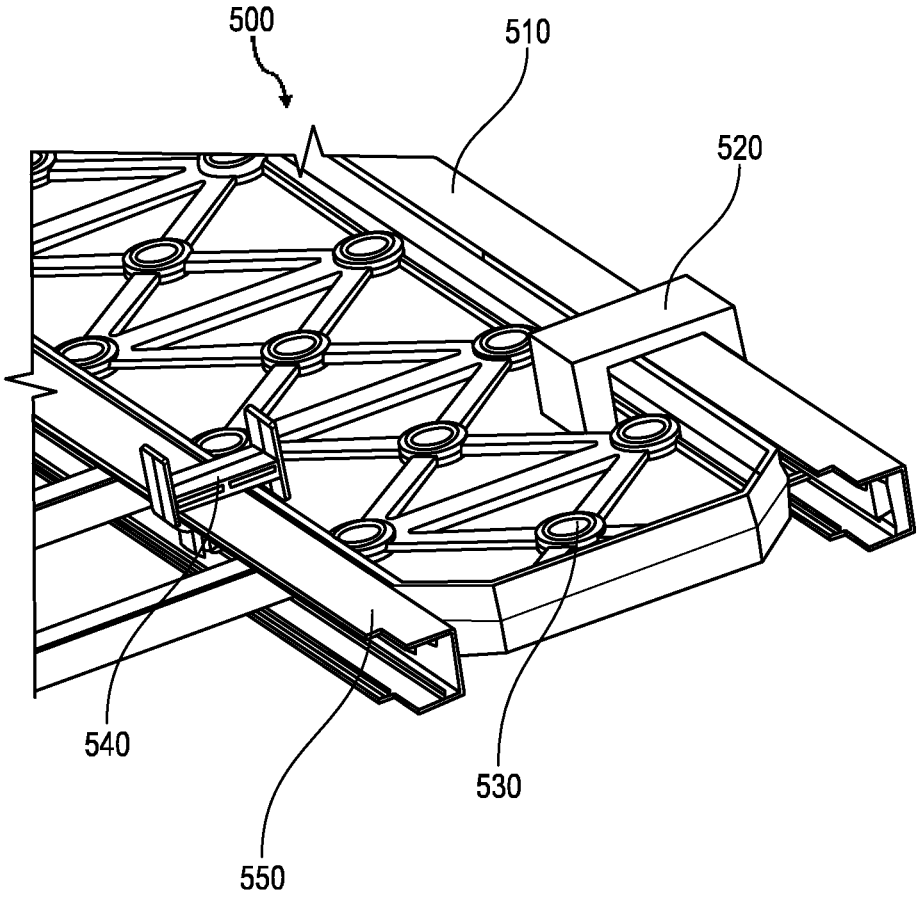
FIG. 5 illustrates a further aspect of the decorative topper system.

In FIG. 5, an additional aspect of the decorative topper system 500 is illustrated. The top rail 510 is illustrated. Under the top rail 510 is the decorative panel 530. A mid-rail 550 is shown to be connected to the decorative panel 530 and also the top rail 510. The press plugs and spring clips under the decorative panel 530 are secured within the picketing holes at the top portion of the mid-rail.

Referring to FIG. 5, mechanisms can be added to secure the top rail 510 onto the decorative panel. In addition, mechanisms can be added to secure the decorative panel within the mid-rail 550. A foam connector 520 is shown at the top of the decorative topper system 500. The foam connector 520 is positioned around the top rail 510 and decorative panel 530. The foam connector 520 ensures that the top rail 110 is secured onto the decorative panel 530. The locking shims on top of the decorative panel 530 can enable the top rail 510 to be secured in part within the decorative panel 530. Nevertheless, the foam connector 520 provides extra security to ensure that the decorative panel 530 and top rail 510 stay connected.

In FIG. 5, an external clip 540 is shown at the bottom of the decorative panel 530 and top of the mid-rail 550. The press plugs and spring clips can secure the decorative panel 530 and top rail 510 onto the mid-rail 550. Nevertheless, the external clip 540, which can be used in multiple positions around the mid-rail 550 and decorative panel 530, provides extra security to ensure that the decorative panel 530, press plugs, spring clips, and also the top rail 510 are positioned within the mid-rail 550.

Referring to FIG. 5, the foam connector 520 and the external clip 540 provide extra security for the decorative topper system 500 in relation to the mid-rail 550. The foam connector 520 ensures that the top rail 510 remains securely connected to the decorative panel 530. In addition, the external clip 540 ensures that the decorative panel 530 remains secured onto the mid-rail 550. As such, both the foam connector 520 and external clip 540 provide extra security connections in addition to the locking shims, press plugs, and spring clips.

Figure 6:
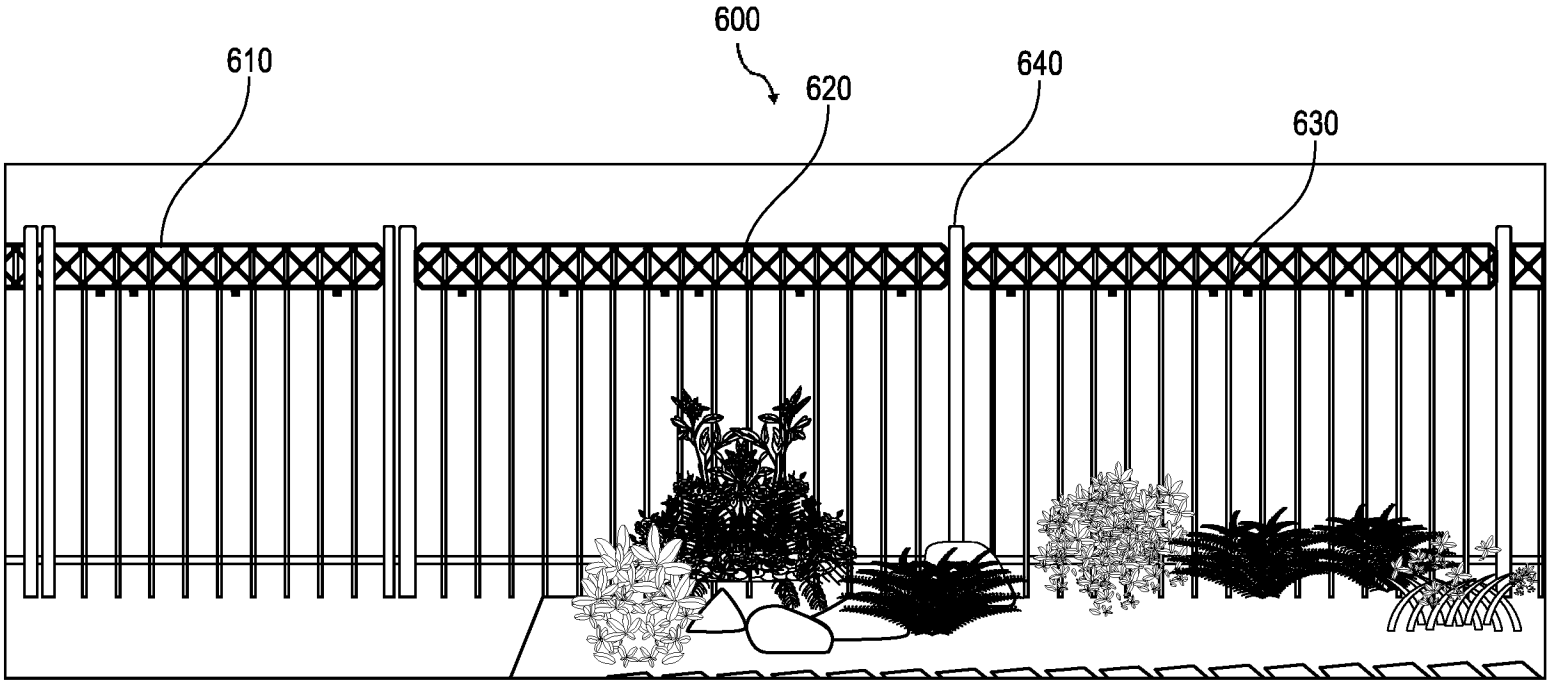
FIG. 6 depicts a view of the decorative topper system.

In FIG. 6, final version of the decorative topper system 600 is illustrated. The decorative topper system 600 is shown being secured over a fence structure. The decorative topper system 600 will include a top rail 610, decorative panel 620, and mid-rail 630. The decorative topper system 600 will also be positioned between gate posts 640.

Referring to FIG. 6, the top rail 610 will be positioned onto the decorative panel 620 using the locking shim parts that are positioned at the top portion of the decorative panel 620. The top rail 610 will be positioned within the locking shim parts on the decorative panel 620. Once the top rail 610 and decorative panel 620 are interconnected within the same device, the top rail 610 and decorative panel 620 need to be connected to the mid-rail 630.

In FIG. 6, the mid-rail 630 is positioned on a top portion of the fence structure. The mid-rail 630 is also positioned between two gate posts 640. In addition, the mid-rail 630 has a plurality of picket holes on the top portion of the mid-rail 630. The picket holes are configured to enable the decorative panel 620 to connect to the mid-rail 630. Accordingly, the decorative panel 620 is positioned within the picket holes. As the top rail 610 is connected to the decorative panel 620, both the top rail 610 and decorative panel 620 are secured and connected to the mid-rail 630 when the decorative panel 620 is secured within the picket holes. As mentioned above in FIG. 5, the foam connector can be used to further ensure that the top rail 610 is secured onto the decorative panel 620. In addition, as also mentioned above in FIG. 5, the external clip can ensure that the decorative panel 620 remains secured onto the mid-rail 610. The entire decorative topper system 600 is thereby positioned between the gate posts 640 and above the vertical pickets of the fence structure. The decorative topper system 600 thereby provides structural and aesthetic enhancement for the fence structure.

Figure 7:
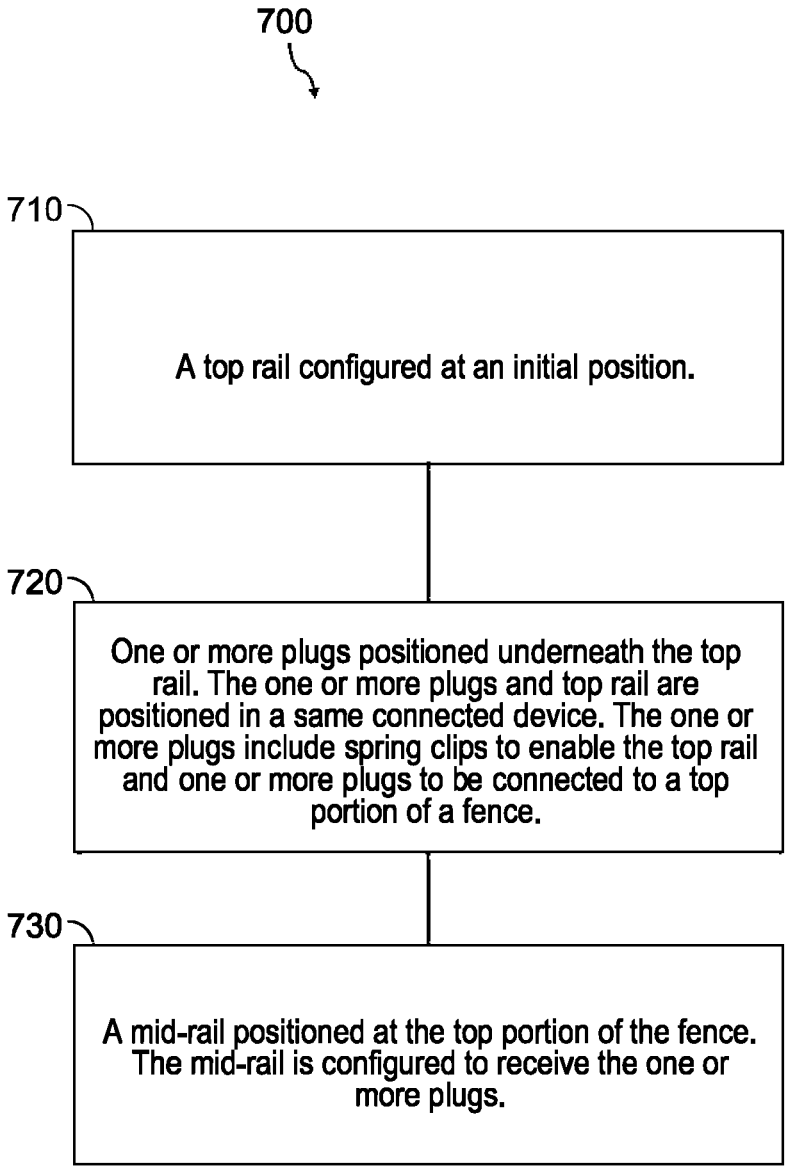
FIG. 7 illustrates a flow chart of the present invention.

Referring to FIG. 7, a method 700 is described for putting together a decorative topper system. The method 700 also includes securing the decorative topper system onto a fence structure.

In FIG. 7, at step 710, a top rail configured at a first position. The top rail can be positioned above a decorative panel. Further, the top rail can also be positioned above shim parts of the decorative panel and also a first rail that is positioned below the decorative panel.

Referring to FIG. 7, at step 720, one or more press plugs will be positioned underneath the top rail. The press plugs and the top rail will be positioned in the same connected device. Spring clips can also be positioned around each of the press plugs. The spring clips will assist the press plugs in being secured within a mid-rail that is positioned at a top of a fence structure. As such, the spring clips enable the press plugs and top rail to be positioned at a top portion of a fence.

In FIG. 7, at step 730, the mid-rail is positioned at the top portion of the fence. The mid-rail includes a plurality of picket holes. The picket holes within the mid-rail enable the top rail to be secured within the mid-rail. Moreover, the press plugs underneath the top rail are positioned within the picket holes on the mid-rail. As a result, the top rail is secured onto the mid-rail. In addition, the decorative panel and first rail are connected to the mid-rail. The entire decorative topper system is thereby secured onto the mid-rail and in between gate posts within the fence.

Advantages/Summary

In summary, the components of the decorative topper system can be first connected together. After the components of the decorative topper system have been connected together, the decorative topper system can be placed at a top portion of a fence. The decorative topper system can be positioned securing within the gate posts and on top of the fence structure. The decorative topper system can provide structural enhancement and aesthetic enhancement for the fence structure.

A top rail can initially be separated from a decorative panel. The decorative panel can include a plurality of locking shim parts. The top rail can be placed onto the locking shim parts to connect to the decorative panel. Underneath the decorative panel, press plugs can be positioned. The press plugs will be connected to the bottom portion of the decorative panel. When the top rail has been connected to the locking shim parts, the top rail is connected to the decorative panel. The decorative topper system is then interconnected with the top rail, decorative panel, and press plugs. The press plugs can include spring clips positioned around the press plugs.

The decorative topper system will be placed at the top portion of the fence structure. The top portion of the fence structure will include a mid-rail. The mid-rail will be positioned between the gate posts at both ends of the fence structure. The mid-rail will also be positioned above the vertical pickets of the fence structure. The mid-rail will also include picket holes at the top portion of the fence. The picket holes are designed to enable the mid-rail to receive the decorative topper system.

The press plugs can be positioned within the picket holes. The spring clips positioned around the press plugs will enable the press plugs to be secured within the picket holes. When the press plugs are secured within the picket holes, the entire decorative topper system is secured onto the top portion of the fence. The top rail, decorative panel, and press plugs are secured within and onto the mid-rail of the fence structure.

The mid-rail will provide structural support for the components of the decorative topper system. The gate posts will also provide structural support for the decorative topper system. The spring clips and press plugs also ensure that the decorative topper system will remain secured within the fence structure. An external clip and foam connector can also ensure the decorative topper system remains secured onto the fence structure. The external foam connector enables the top rail to remain secured onto the decorative panel. The external clip ensures that the decorative panel remains secured onto the mid-rail. As such, the external foam connector ensures that the components remain interconnected. Further, the external clip ensures that the components of the decorative topper system remain interconnected with the mid-rail of the fence structure. The decorative topper system, when secured within the fence structure, will provide a structural and aesthetic enhancement for the fence structure.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments.

The invention claimed is:

1. A system comprising:

a top rail configured at an initial position;

one or more plugs positioned underneath the top rail, wherein the one or more plugs and top rail are positioned within a same connected device, wherein the one or more plugs include spring clips positioned around the one or more plugs to enable the top rail and one or more plugs to be connected to a top portion of a fence;

a connector positioned proximal to the top rail, the connector configured to secure the top rail to a decorative panel; and a mid-rail positioned at the top portion of the fence, wherein the mid-rail is configured to receive the one or more plugs.

2. The system of claim 1, further comprising:

one or more external clips to secure the one or more plugs and top rail onto the mid-rail.

3. The system of claim 1, further comprising:

a decorative panel positioned between the top rail and the one or more plugs.

4. The system of claim 1, further comprising:

one or more external clips to connect the one or more plugs and top rail to the same connected device.

5. The system of claim 1, further comprising:

a plurality of holes within the mid-rail to receive the one or more plugs.

6. The system of claim 1, further comprising:
a plurality of pickets connected to the mid-rail and top rail.

7. The system of claim 1, further comprising:
one or more end posts to provide structural support to the mid-rail.

8. A system comprising:
a first rail configured at a first position;
a decorative panel positioned underneath the first rail, wherein the decorative panel is configured to be connected to the first rail;
a connector positioned at least partially around a portion of the first rail and a portion of the decorative panel, the connector configured to secure the first rail to the decorative panel;
a plurality of plugs configured underneath the decorative panel and first rail, wherein the plurality of plugs are connected to the decorative panel, and wherein the plurality of plugs enable the first rail and decorative panel to be connected to a second rail;
one or more spring clips positioned around the plurality of plugs to enable the plurality of plugs to be connected to the second rail; and
the second rail positioned underneath the plurality of plugs, wherein the second rail is configured with a plurality of holes, wherein the plurality of holes enable the plurality of plugs to connect the first rail and decorative panel to the second rail, wherein the second rail is positioned over one or more vertical pickets.

9. The system of claim 8, further comprising:
one or more external clips to secure the plurality of plugs and decorative panel onto the second rail.

10. The system of claim 8, further comprising:
one or more external connectors to secure the decorative panel onto the first rail.

11. The system of claim 8, further comprising:
an external clip positioned above the plugs in contact with the decorative panel and below the second rail.

12. The system of claim 8, further comprising:
a bottom rail to provide structural support to the one or more vertical pickets.

13. The system of claim 8, further comprising:
a plurality of side gates to provide structural support for the first rail, decorative panel,
and second rail.

14. A method comprising:
configuring a top rail at an initial position;
positioning one or more plugs underneath the top rail, wherein the one or more plugs and top rail are positioned within a same connected device, wherein the one or more plugs include spring clips positioned around the one or more plugs to enable the top rail and one or more plugs to be connected to a top portion of a fence;
positioning one or more connectors proximal to the top rail and a portion of the connected device, wherein the one or more connectors secure the top rail to the connected device; and
configuring a mid-rail at the top portion of the fence, wherein the mid rail is configured to receive the one or more plugs.

15. The method of claim 14, further comprising:
configuring external connectors or clips around the top rail and the mid-rail to secure the connection between the top rail and mid-rail.

16. The method of claim 14, further comprising:
positioning a decorative panel between the one or more plugs and top rail.

17. The method of claim 14, further comprising:
positioning vertical rails underneath the mid-rail to provide structural support for the mid-rail, one or more plugs, and top rail.

18. The method of claim 14, further comprising:
positioning at least one gate on a side of the mid-rail and top-rail to provide structural support for the mid-rail and top rail.

19. The method of claim 14, further comprising:
positioning a bottom rail above the mid-rail and plurality of plugs, to provide structural support to the mid-rail, plurality of plugs, and top rail.

* * * * *